US005213368A

United States Patent [19]

Wyant

[11] Patent Number: 5,213,368

[45] Date of Patent: May 25, 1993

[54] LOOSE-LEAF BINDER HAVING FLEXIBLE SPINE

[75] Inventor: Jon R. Wyant, Spring Valley, Ohio

[73] Assignee: The Mead Corporation, Dayton, Ohio

[21] Appl. No.: 874,417

[22] Filed: Apr. 27, 1992

[51] Int. Cl.[5] ..... B42F 13/00; B42F 13/38

[52] U.S. Cl. ..... 281/18; 281/29; 281/36; 402/73; 402/76; 402/80 R

[58] Field of Search ..... 281/18, 29, 36; 402/80 R, 73, 76

[56] References Cited

U.S. PATENT DOCUMENTS

| | | | |
|---|---|---|---|
| 485,814 | 11/1892 | Kent . | |
| 515,687 | 2/1894 | Jeschke . | |
| 518,628 | 4/1894 | Ray . | |
| 529,614 | 11/1894 | Frith . | |
| 2,517,640 | 8/1950 | D'Huy | 281/29 |
| 3,572,957 | 3/1971 | Strassberg | 402/75 |
| 3,833,244 | 9/1974 | Heimann | 281/21 R |
| 3,833,308 | 9/1974 | Seaborn | 402/56 |
| 4,630,843 | 12/1986 | Willat | 281/30 |
| 4,932,679 | 6/1990 | Mayer et al. | 281/18 |
| 5,020,828 | 6/1991 | Moor | 281/29 |

FOREIGN PATENT DOCUMENTS

| | | | |
|---|---|---|---|
| 1186028 | 1/1965 | Fed. Rep. of Germany | 251/29 |
| 1525272 | 5/1968 | France | 251/36 |

*Primary Examiner*—Paul A. Bell
*Attorney, Agent, or Firm*—Biebel & French

[57] ABSTRACT

A binder comprises front and rear rectangular cover panels, a sheet retaining assembly, and a spine sheet. The rear cover panel has a width between its first and second opposite side margins. The retaining assembly is mounted on the rear cover panel adjacent to the first side margin of the rear panel and extends along the first side margin. The front cover panel has a width between its first and second opposite side margins. The first side margin of the front panel is disposed parallel to the first side margin of the rear panel. The front panel is less in width than the rear panel, and the difference in width between the front and rear panels is greater than the transverse dimension of the sheet retaining assembly. The spine sheet extends between and foldably joined along fold lines to the first side margins of the front and rear panels, and has a width between the first side margins of the front and rear panels. The width of the spine sheet is greater than the difference in width between the front and rear panels.

22 Claims, 7 Drawing Sheets

14
11
24
20
26
52
18
52
16
12

T
16
20
21
10
12
14
28
22
23
72
21
18
70
24
52
50

11
14
64
18
62
16'
12
80

LOOSE-LEAF BINDER HAVING FLEXIBLE SPINE

BACKGROUND OF THE INVENTION

The present invention relates to a binder having a pair of covers, a spine interconnecting the covers and a sheet retaining assembly for holding a plurality of sheets between the covers, and more particularly to a binder whose spine is flexible and capable of being routed around a sheet retaining assembly to provide a convenient grip for users and to permit the covers to lie parallel to each other irrespective of the number of sheets retained within the binder.

FIG. 10 illustrates a typical prior art binder 90 wherein front and rear covers 96 and 94 are interconnected by a spine 98. A pair of hinge lines 91 and 93 join the spine 98 to the covers 94 and 96, respectively. A snap ring assembly 92 is riveted or otherwise fastened directly to the rear cover 94. The spine panel 98 is free to pivot away from the snap ring assembly 92 in the direction indicated by the arrow 97 to provide convenient access to the assembly 92. The width of the spine 98 is great enough to enable the covers 96 and 94 to clear the snap rings. This type of binder is particularly well-suited to uses requiring oversized snap rings for maintaining a great number of loose-leaf sheets. Such a binder, however, requires excessive shelf space, and it it difficult to grasp at the wide, flat and pivotable spine 98.

It is therefore seen that there is a need to provide an improved binder. Such a binder should reduce shelf space requirements, and fit in users' hands when gripped at the spine.

SUMMARY OF THE INVENTION

The present invention provides an improved binder having a flexible spine interconnecting front and rear stiff covers. The rear cover is rectangular in shape and has inner and free/outer opposite side margins. A sheet retaining assembly is mounted on the rear cover adjacent to the inner side margin of the rear cover and extends along the inner side margin. The front cover is also rectangular in shape and also has inner and free opposite side margins. The inner side margins of the front and rear covers are disposed parallel to each other. The width of the front cover between its opposite side margins is less than the width of the rear cover between the opposite side margins of the rear cover. The difference in width between the front and rear covers is greater than the transverse dimension of the sheet retaining assembly. The spine extends between the respective inner side margins of the front and rear covers, and is foldably joined to the respective inner side margins along fold lines. The width of the spine between the inner side margins is greater than the difference in width between the front and rear covers.

When the above-mentioned binder is in a closed condition, the spine is joined to the rear cover along an outwardly bent fold line which is coextensive with the inner side margin of the rear cover, whereas the front cover is joined to the spine along a reversely bent fold line which is coextensive with the inner side margin of the front cover. The spine is naturally curved or routed along an arc which substantially encompasses the sheet retainer, while the front cover lies flat against any sheets retained in the binder and remains parallel to the rear cover without interfering with the sheet retainer irrespective of the number of sheets retained within the binder. This feature of the binder allows the binder to fit in users' hands when it is grasped at the spine area and also contribute toward reducing shelf/storage space requirements. The difference in width of the front and rear covers allows the respective free margins of the covers to remain in alignment.

In one preferred embodiment, the retaining assembly has a plurality of engaging members which allow addition and removal of sheets to vary the volume of sheets. Such engaging members are preferably annular in shape. These annular members are coaxially disposed at intervals along the inner margin of the rear cover. In this embodiment, the difference in width between the front and rear covers is greater than the outer size, i.e., the outer diameter, of the annular members. Such a retaining assembly may be a conventional device commonly known as snap ring assembly or a slide ring device of the type shown in U.S. Pat. No. 3,833,308 to Seaborn.

In another preferred embodiment, the binder has a flexible closure flap joined to and extending from the rear cover. The closure flap has a fastener such as a Velcro® fastener attached thereon for releasable engagement with the front cover. The closure flap with such a fastener is capable of locking the front cover in a closed and parallel position with respect to the rear cover irrespective of the number of sheets retained within the binder.

According to another embodiment of the present invention, each of the front and rear covers includes interior and exterior superposed plastic sheets and a stiffener board interposed between the sheets. The interior and exterior sheets are attached to each other along their respective peripheries, and thus the stiffener board is completely enclosed in the sheets. The spine comprises first and second laminated plastic layers. The first layer is continuous and integral with the exterior sheets of the front and rear covers, whereas the second layer is continuous and integral with the interior sheets of the front and rear covers. A third plastic layer may be laminated on the first layer.

The present invention also provides a binder having a closure flap of a durable structure. The rear cover of this binder has a free margin opposite the spine of the binder. This free margin is provided with a cutout defined by an essentially U-shaped edge. The closure flap which is releasably engageable with the front cover is joined to the rear cover along the U-shaped edge. The U-shaped joint or juncture between the flap and the rear cover prevents repeated folding stress from being concentrated thereon; the U-shaped juncture prevents itself from serving as a fold line, and therefore folding stress can be more uniformly distributed over the flap.

Accordingly, it is an object of the present invention to provide a binder that is easy to hold and carry.

Another object of the present invention is to provide a binder that requires a minimal amount of space for storage.

Still another object of the present invention is to provide a binder which has a front cover reversely folded in order to maintain the front and rear covers parallel to each other irrespective of the number of sheets retained therein.

A further object of the present invention is to provide a binder having a durable closure flap.

Other objects and advantages of the invention will be apparent from the following description, the accompanying drawings and the appended claims.

DETAILED DESCRIPTION OF THE INVENTION

Figure 1:
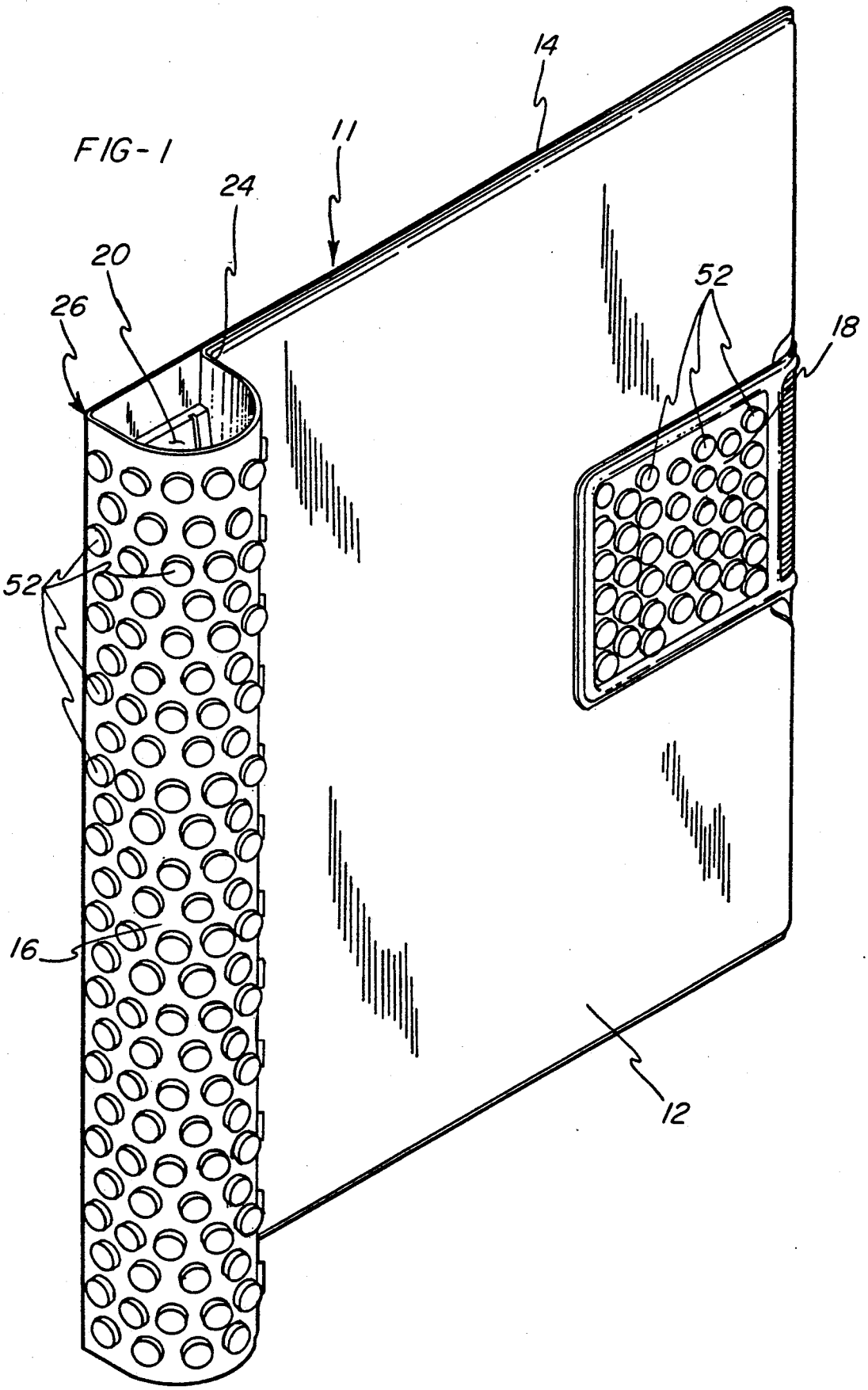
FIG. 1 is a perspective view of a binder according to the present invention, showing the binder in a closed condition.

Referring to FIGS. 1 to 9, like reference numerals in all views designate corresponding parts, and descriptions of these corresponding parts are omitted after being given once.

FIGS. 1 to 7 illustrate a binder, generally designated 11, in accordance with the present invention. The binder 11 includes front and rear covers 12 and 14 interconnected by a spine 16, a closure flap 18 for locking the front cover 12 in a closed position relative to the rear cover 14, and a sheet retaining assembly 20 for releasably holding a plurality of sheets such as loose-leaf sheets.

Figure 2:
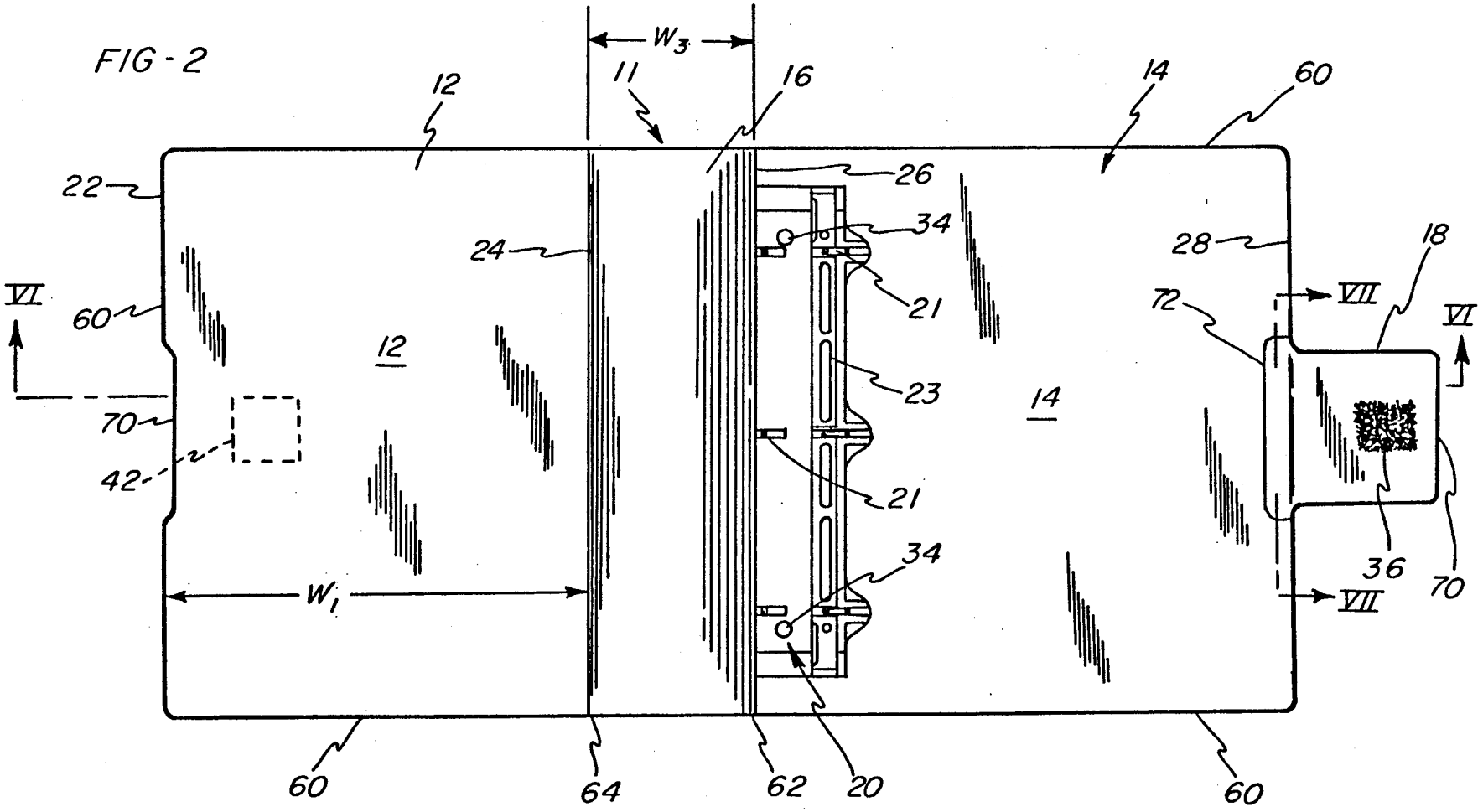
FIG. 2 is a plan view of the binder of FIG. 1 in an opened condition.

The front and rear covers 12 and 14 are generally rectangular panel-like members, each having a free side margin and an inner side margin opposite the free side margin. As best shown in FIG. 2, the front cover 12 has a width (W1) between its inner and free side margins 24 and 22 whereas the rear cover 14 has a width (W2) between its inner and free side margins 26 and 28. The width (W1) of the front cover 12 is less than the width (W2) of the rear cover 14. The difference between the widths (W1 and W2) is predetermined based on the size of the sheet retaining assembly, which will be described later in more detail. The free margins 22 and 28 of the front and rear covers 12 and 14 are provided respectively with cutouts defined by U-shaped edges 70 and 72.

As best shown also in FIG. 2, the spine 16 is generally rectangular in shape but is a flexible sheet-like member. This spine 16 is foldably joined at one of its longer edges to the rear cover 14 along a fold line 62 while it is foldably joined at the other longer edge to the front cover along a fold line 64. As will be apparent from FIG. 2, the fold lines 62 and 64 run coextensively with the inner side margins 26 and 24, respectively. The width (W3) of the spine 16 is greater than the difference in width between the front and rear covers 12 and 14. This will be described later in more detail with a description of the retaining assembly 20.

Figure 3:
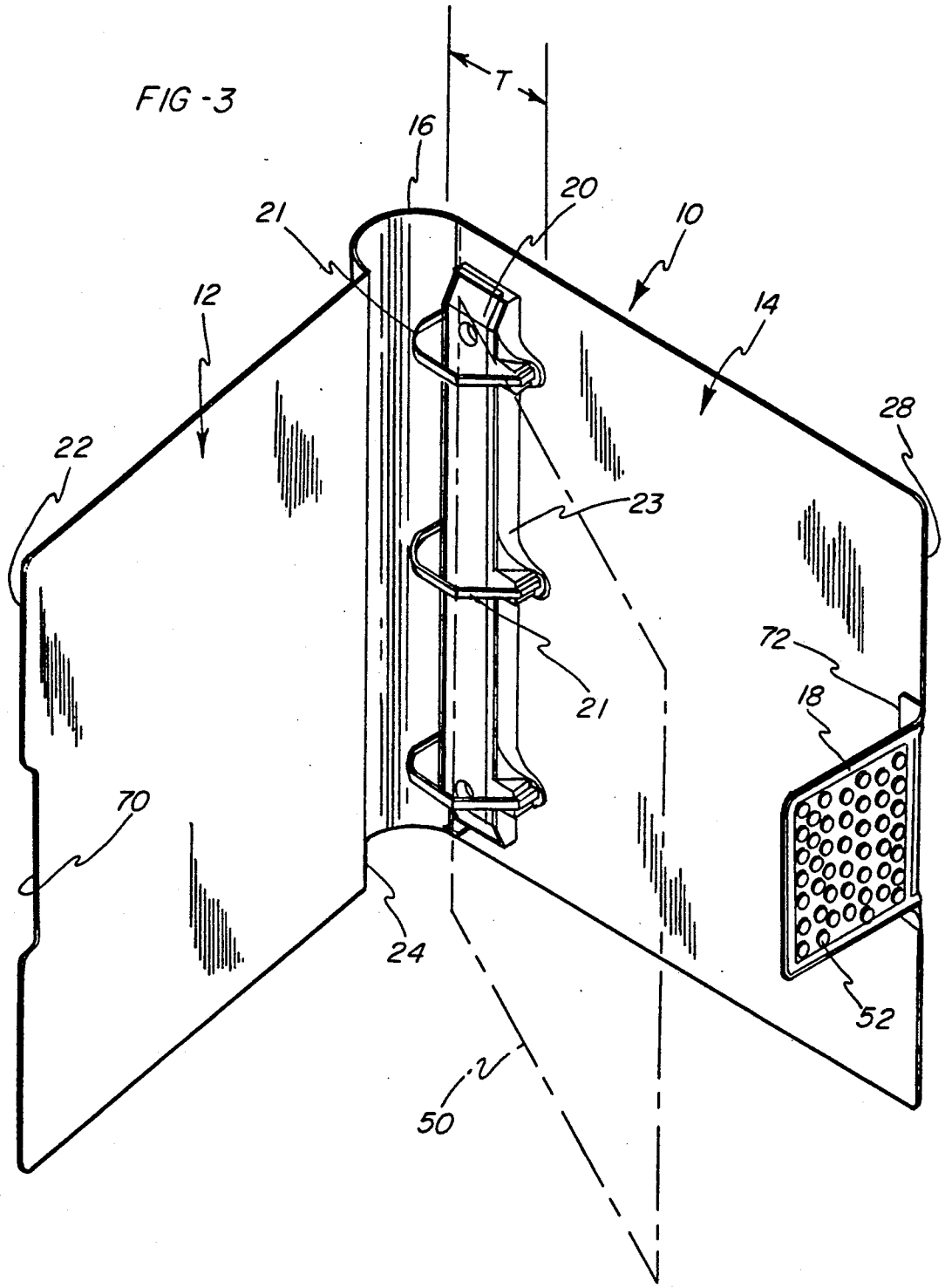
FIG. 3 is a perspective view of the binder of FIG. 1 in a half opened condition.

The sheet retaining assembly may be any conventional means for allowing addition and removal of sheets; however, a slide ring device 20 such as shown in FIGS. 2 and 3 is preferably used in the present invention. This assembly 20 as illustrated includes arcuate or essentially semicircular engaging members 21 carried by an elongated base member 23. The base member 23 is mounted on the inside surface of the rear cover 14 adjacent to the inner side margin 26 and extends along the inner side margin 26. Rivets 34 or other suitable fastening means are used for the purpose of securing the assembly 20 to the cover 14. The engaging members 21 are coaxially arranged at equal intervals along the base member 23. A sliding mechanism which is incorporated in the base member 23 permits the engaging members 21 to be opened as shown in FIG. 2 and to be closed as shown in FIG. 3. Further structural details of a slide ring device of this type are described in U.S. Pat. No. 3,833,308 to Seaborn.

As best shown in FIG. 3, the retaining assembly 20 has a transverse dimension (T), i.e., the transverse outer size of the engaging members 21, along the width (W2) of the rear cover 14. This dimension (T) is less than the aforementioned difference in width between the front and rear covers 12 and 14. In other words, the difference in width between the front and rear covers 12 and 14 is designed such that the free side margin 22 can be brought into substantial alignment with the free side margin 28 when the inner side margin 24 is positioned beside the assembly 20 as shown FIG. 1.

Figure 4:
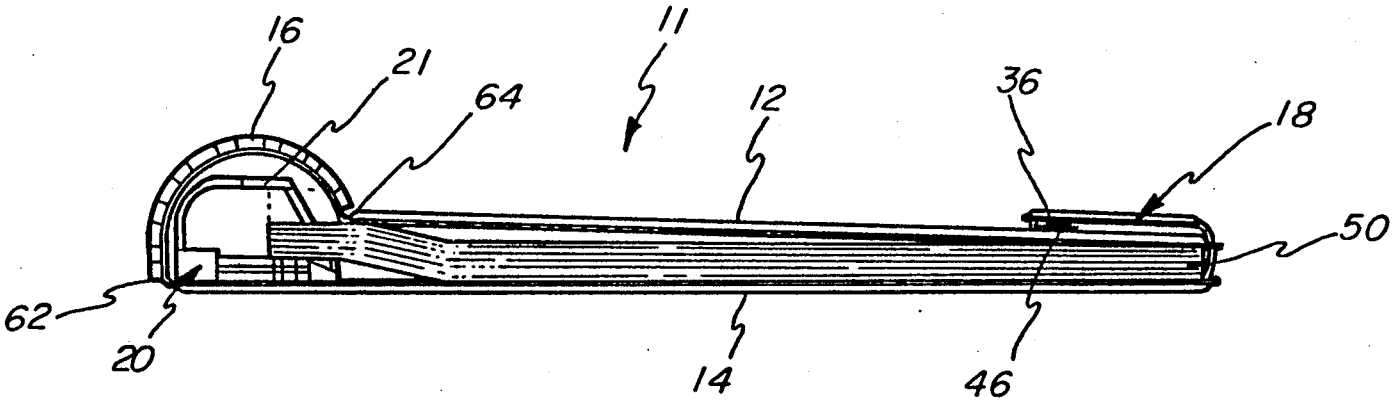
FIG. 4 is a side-elevational view of the binder of FIG. 1 with sheets of paper retained therein.

As described earlier, the width (W3) of the spine 16 is greater than the difference in width between the front and rear covers 12 and 14. This width (W3) is preferably greater than the circumference of the engaging members 21, i.e., the length of the arc defined by each engaging member 21. Such a width permits the spine 16 to be routed conformingly around the engaging members 21 when the binder 11 is closed. This is best illustrated in FIG. 4 wherein the spine 16 arcuately encompasses the engaging members 21 and permits the front cover 12 to lie substantially flat on the rear cover 14 or on the sheets 50 stacked on the rear cover 14. The fold line 62 is outwardly bent so as to allow the spine 16 to reach encirclingly around the engaging members 21 whereas the fold line 64 is reversely bent so as to allow the front cover 12 to remain substantially parallel to the rear cover 14. It will be readily understood that the front cover 12 lays flat against the rear cover 14 when the binder 11 is empty or loaded with only a few sheets and that the front cover 12, as more sheets are added, spreads away from the rear cover 14 while maintaining a substantially parallel relation to the rear cover 14.

Figure 10:
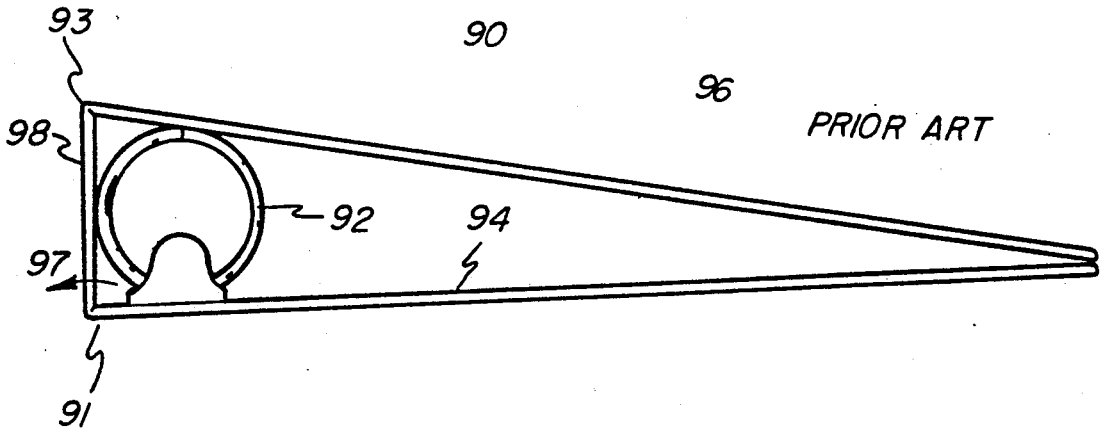
FIG. 10 is a side-elevational view of a prior art binder.

In place of the aforementioned assembly 20, a sheet retaining device commonly known as a snap ring assembly may be used in the present invention. Such a device is shown, for instance, in FIG. 10. In this case, the width of the spine is preferably greater than a half of the circumference of the snap rings to enable the spine to arcuately encompasses the snap rings.

The closure flap 18 is a flexible sheet-like member. As best shown in FIG. 2, the closure flap 18 is joined at its proximal end to the rear cover 14 along the U-shaped edge 72 and extends to its free end 73. A patch of hook and loop fastener material 36 is attached to the inside surface of the flap 18 near the free end 73 to releasably fasten the flap 18 to the front cover 12. A cooperating patch of hook and loop fastener material 42 is mounted on the outside surface of the front cover 12 near the edge 70. Although not shown in the drawings, the patch 36 and/or the patch 42 may be of an elongated configuration and may extend along the width of the front cover 12 or along the length of the flap 18.

Figure 5:
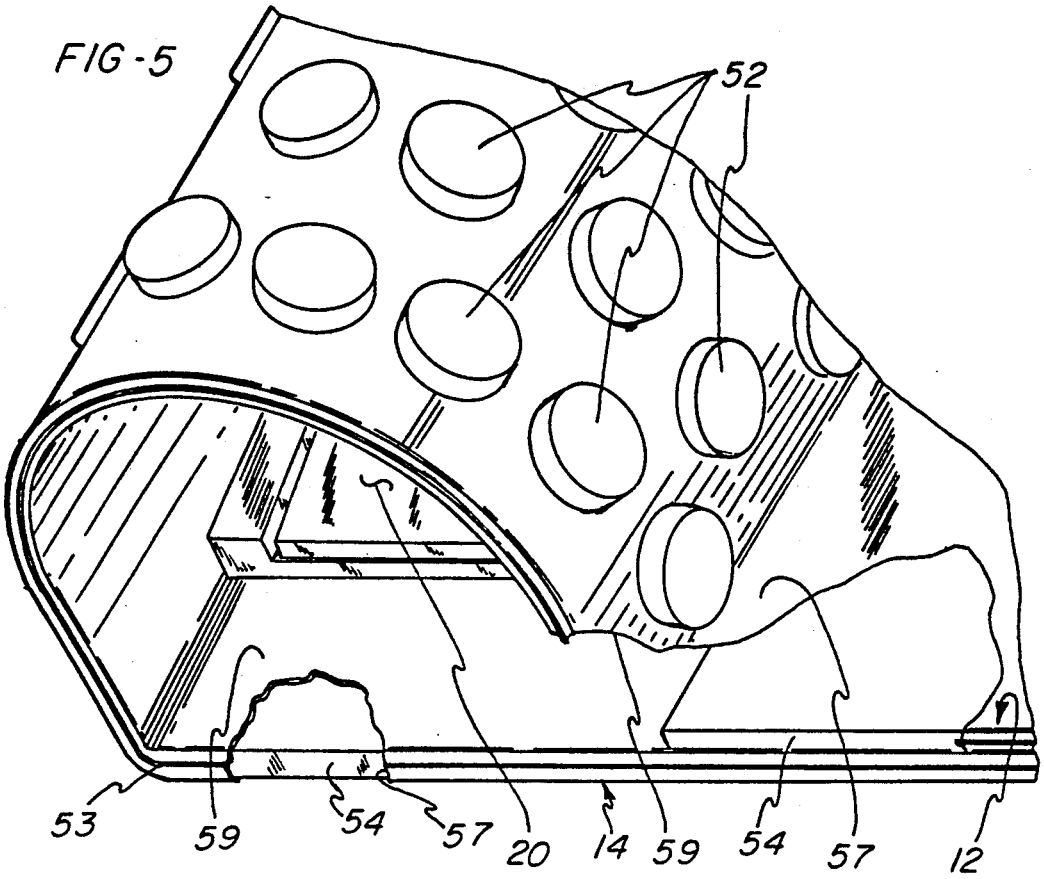
FIG. 5 is an enlarged perspective view, partially cut-away, of a spine region of the binder in FIG. 1.
Figure 6:
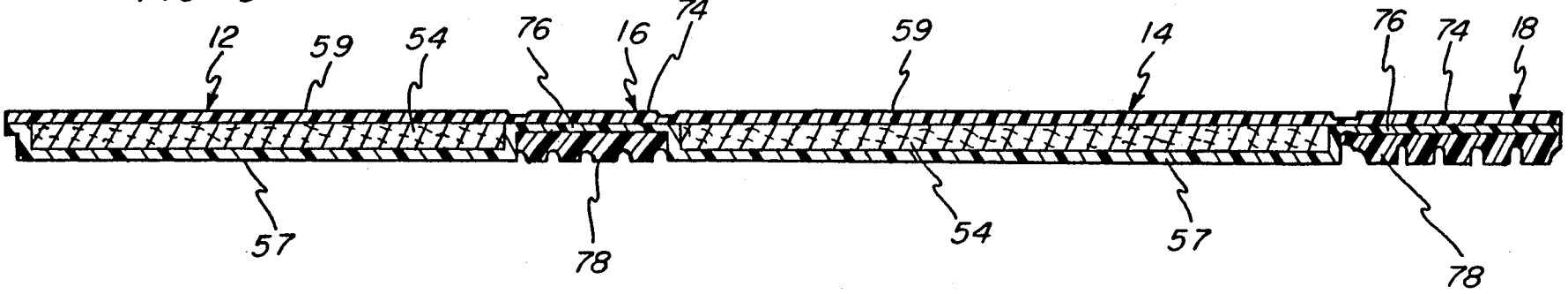
FIG. 6 is a view taken along the line VI—VI of FIG. 2.
Figure 7:
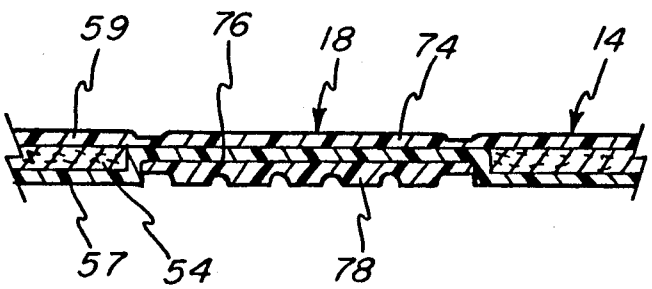
FIG. 7 is a view taken along the line VII—VII of FIG. 2.

FIGS. 5 to 7 illustrate the structural details of the covers 12 and 14 and other parts of the binder 11 according to one preferred embodiment. As best shown in FIG. 6, each cover includes a stiffener board 54 and interior and exterior plastic sheets 59 and 57. The interior plastic sheet 59 is laid over the exterior sheet 57, and the stiffener board 54 is interposed between the sheets 57 and 59. The plastic sheets are attached to each other by means, for instance, of heat sealing along their peripheries 60 (see FIG. 2) so that the stiffener board 54 is completely enclosed in the plastic sheets 57 and 59. The periphery sealing process provides a sealing line 53, as illustrated in FIG. 5. It will be readily understood that the interior and exterior sheets 59 and 57 respectively provide the inside and outside surfaces of each cover.

As further shown in FIG. 6, each of the spine 16 and the flap 18 includes inner, intermediate and outer laminated plastic layers 74, 76 and 78. The inner layer 74 is continuous and integral with the interior sheet 59 whereas the intermediate layer 76 is continuous and integral with the exterior sheet 57. The outer plastic layer 78 is a separate plastic sheet laminated on the intermediate layer 76.

The stiffener board 54 is preferably formed of laminated paperboard. For instance, the board 54 comprises die-cut sheets of 110 point (?) chipboard. The plastic sheets 59 and 57, i.e., the layers 74 and 76, are formed of sheet vinyl. The sheet vinyl should be thin enough to provide the spine 16 with flexibility. At the same time, the sheet vinyl must be of a thickness which provides structural integrity at the spine 16. Such sheet vinyl may comprises a 12 point (?) vinyl sheet. The outer layer 78 may be formed of foam plastic and is laminated by means of a heat sealing die. Such a heat sealing die is configured to produce a pleasant decorative effect, such as a pattern of nodules 52 (see FIGS. 1 and 5) on the outer layer 78. The nodules 52 lend structural integrity as well as a decorative appearance.

Figure 9:
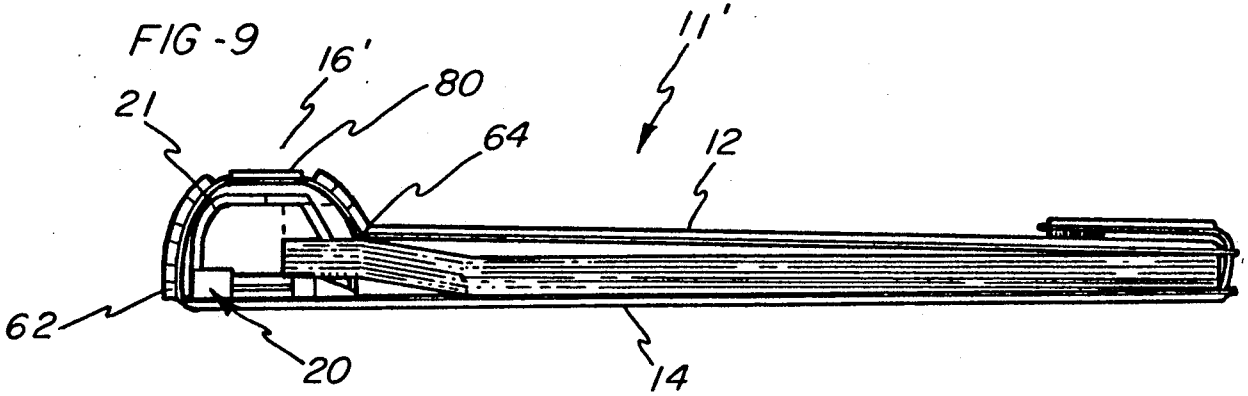
FIG. 9 is a side-elevational view of the binder of FIG. 8 with sheets of paper retained therein.
Figure 8:
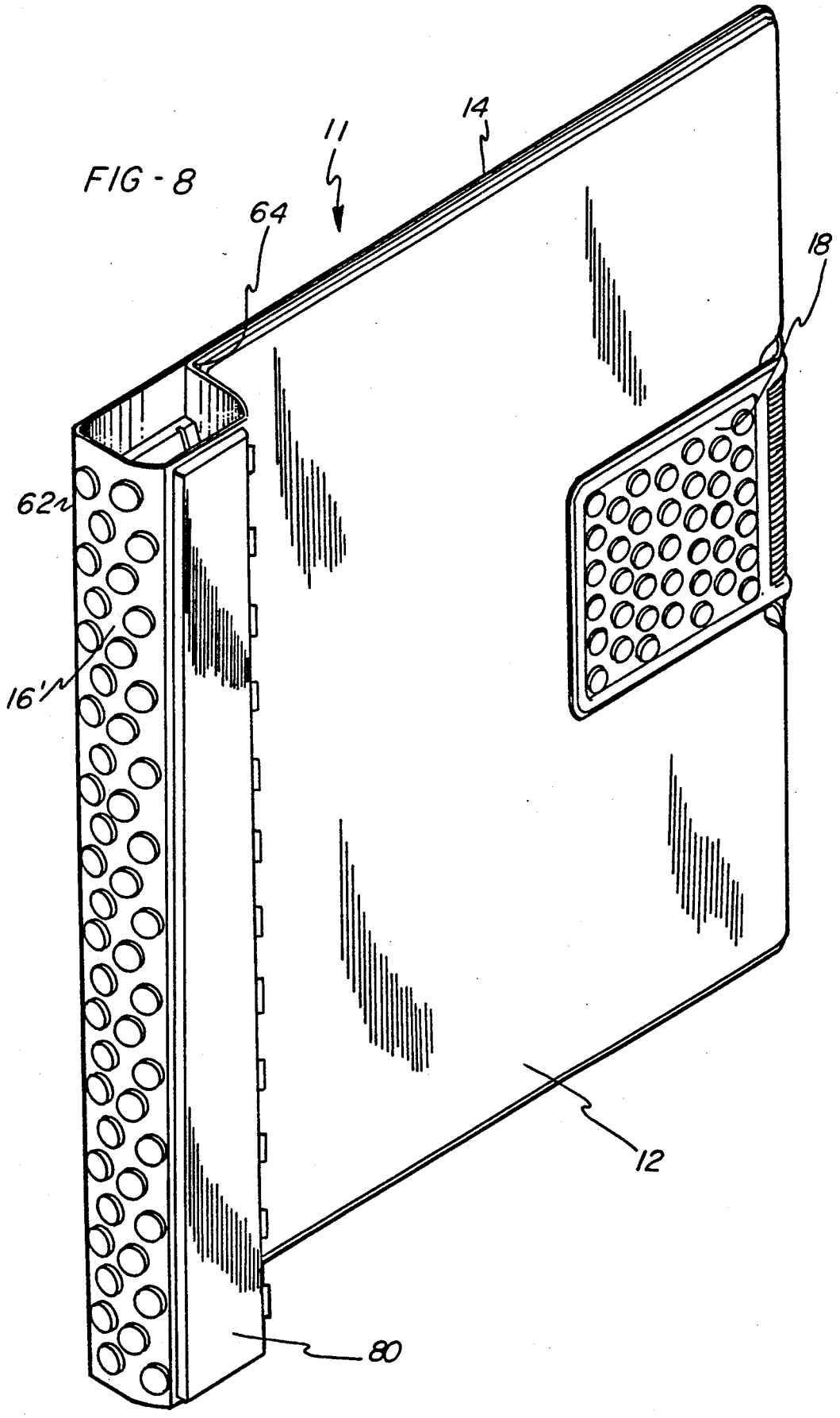
FIG. 8 is a perspective view of a binder according to an alternative embodiment of the present invention.

FIGS. 8 and 9 illustrate a binder 11' according to an alternative embodiment of the present invention. The spine 16' of this binder 11' includes a slat portion 80 extending along the fold lines 62 and 64. The slat portion 80 includes a stiffener strip (not shown) sandwiched by the inner and outer plastic layers. The stiffener strip makes the slat portion stiffer than the remainder of the spine 16'. When the binder 11' is closed and thereby the spine 16' is routed along the engaging members 21, the slat portion 80 bridges between the engaging members 21 to provide a stable grip.

Having described the invention in detail and by reference to the preferred embodiments thereof, it will be apparent that modification and variation are possible without departing from the scope of the invention defined in the appended claims.

What is claimed is:

1. A binder comprising:

front and rear cover panels interconnected by a spine for receiving a plurality of sheets therebetween, said rear cover panel having a free margin opposite said spine, said free margin being provided with a cutout defined by an essentially U-shaped edge; and a flexible closure flap extending from said rear cover panel and having fastening means for releasable engagement with said front cover panel, said flap being joined to said rear cover panel along said U-shaped edge.

2. The binder according to claim 1 wherein said rear cover panel comprises an exterior plastic sheet member, an interior plastic sheet member overlaying said exterior sheet member, and a stiffener board interposed between said sheet members, said sheet members being attached to each other along their respective peripheries so that said stiffener board is completely enclosed in said sheet members, and said closure flap comprises first and second laminated plastic layers, said first layer being continuous and integral with said exterior sheet member of said rear cover panel, said second layer being continuous and integral with said interior sheet member of said rear cover panel.

3. The binder according to claim 2 wherein said closure flap further comprises a third plastic layer laminated on said first layer.

4. A loose-leaf binder comprising:

a generally rectangular and relatively stiff rear cover provided with a free side margin and an inner side margin disposed opposite said free side margin;

elongated sheet retaining means mounted on said rear cover adjacent to and parallel to said inner side margin;

a rounded, flexible spine joined to the inner side margin of said rear cover along an outwardly bent fold line and extending therefrom along an arc which substantially encompasses said sheet binding means; and a generally rectangular and relatively stiff front cover provided with an inner side margin and a free side margin disposed opposite said inner side margin of said front cover, said front cover being joined to said spine along a reversely bent fold line so that said front cover remains substantially parallel to said rear cover as sheet stacks of different thickness are retained by said retaining means, said front cover further having a width between said side margins thereof such that said free side margin of said front cover is in general alignment with the free side margin of said rear cover.

5. The binder according to claim 4 further comprising a closure flap joined to and extending from said rear cover, said flap having fastening means for releasable engagement with said front cover.

6. The binder according to claim 5 wherein said flap extends to a free end, said fastening means comprises a first hook and loop fastener fixedly disposed on said flap, and said front cover panel comprises a second hook and loop fastener fixedly disposed thereon for releasable engagement with said first hook and loop fastener, at least one of said first and second hook and loop fasteners extending parallel to said width of said front cover panel whereby said flap can be fastened to said front cover panel with said free end being disposed at any desired position along a portion of said width of said front cover panel.

7. The binder according to claim 5 wherein said flap means comprises heat sealed vinyl sheets.

8. The binder according to claim 4 wherein said sheet retaining means comprises a plurality of snap rings coaxially disposed at intervals along said inner side margin.

9. The binder according to claim 4 wherein said spine comprises heat sealed vinyl sheets.

10. The binder according to claim 9 wherein said vinyl sheets are locally deformed in a pattern which improves the structural integrity of said spine.

11. The binder according to claim 4 further comprising a first vinyl surface sheet overlaying said front and rear covers, and a second vinyl sheet underlying on said front and rear covers, said binder having a periphery, said first and second vinyl surface sheets being heat sealed together along said periphery of said binder.

12. The binder according to claim 4 wherein each of said front and rear cover panels comprises an exterior plastic sheet member, and interior plastic sheet member overlying said exterior sheet member, and a stiffener board interposed between said sheet members, said sheet members being attached to each other along their respective peripheries so that said stiffener board is completely enclosed in said sheet members.

13. The binder according to claim 12 wherein said spine sheet comprises first and second laminated plastic layers, said first layer being continuous and integral with said exterior sheet members of said front and rear cover panels, said second layer being continuous and integral with said interior sheet members of said front and rear cover panels.

14. The binder according to claim 13 wherein said spine sheet further comprises a third plastic layer laminated on said first layer.

15. A binder comprising:

a generally rectangular rear cover panel having a free side margin and an inner side margin disposed opposite said free side margin, said rear cover panel having a width between said side margins thereof;

sheet retaining mens for releasably holding sheets, said retaining means being mounted on said rear cover panel adjacent to said inner side margin and extending along said inner side margin, said retaining means having a transverse dimension along said width of said rear cover panel;

a generally rectangular front cover panel having an inner side margin and a free side margin disposed opposite said inner side margin of said front cover panel, said inner side margin of said front cover panel being disposed parallel to said inner side margin of said rear cover panel, said front cover panel having a width between said inner and free side margins thereof, said front cover panel being less in width than said rear cover panel, the difference in width between said front and rear cover panels being greater than said transverse dimension of said sheet retaining means; and a spine sheet extending between and foldably joined along fold lines to said inner side margins of said front and rear cover panels, said spine sheet having a width between said inner side margins, said width of said spine sheet being greater that the difference in width between said front and rear cover panels.

16. The binder according to claim 15 further comprising a flexible closure flap joined to and extending from said rear cover panel near said free margin of said rear cover panel, said closure flap having fastening means for releasable engagement with said front cover.

17. The binder according to claim 16 wherein said closure flap extends to a free end, said fastening means comprises a first hook and loop fastener fixedly disposed on said closure flap, and said front cover panel comprises a second hook and loop fastener fixedly disposed thereon for releasable engagement with said first hook and loop fastener, at least one of said first and second hook and loop fasteners extending parallel to said width of said front cover panel whereby said closure flap can be fastened to said front cover panel with said free end being disposed at any desired position along a portion of said width of said front cover panel.

18. The binder according to claim 16 wherein said free margin of said rear cover panel is provided with a cutout defined by an essentially U-shaped edge, and said closure flap is joined to said rear cover panel along said U-shaped edge.

19. The binder according to claim 15 wherein said retaining means comprises a plurality of engaging members allowing addition and removal of sheets to vary the volume of sheets, said engaging members being disposed at intervals along said inner margin of said rear cover panel, said engaging member having a transverse outer size along said width of said rear cover panel, and said transverse dimension is said transverse outer size.

20. The binder according to claim 19 wherein said engaging members are generally annular in shape and define a circumference at the outer diameter thereof, said engaging members being disposed coaxially with each other, and said width of said spine sheet is such that said spine sheet is routed along said circumference of said engaging members when said front cover panel is opposed parallel to that portion of said rear cover panel between said retaining means and said free margin of said rear cover panel.

21. The binder according to claim 20 wherein said width of said spine sheet is greater than a half of said circumference of said engaging members.

22. The binder according to claim 20 wherein said spine sheet includes a slat portion extending along said inner margins, said slat portion being stiffer than the remainder of said spine sheet whereby said slat portion bridges between said engaging members when said spine sheet is routed along said circumference of said engaging members.

* * * * *